US006659576B1

(12) United States Patent
Welch

(10) Patent No.: US 6,659,576 B1
(45) Date of Patent: Dec. 9, 2003

(54) METHOD AND DEVICE FOR MOUNTING A MODULAR DRAWER AND SUPPORT INSIDE A CABINET

(76) Inventor: Herb Welch, 6 Isleworth Dr., Henderson, NV (US) 89052

( * ) Notice: Subject to any disclaimer, the term of this patent is extended or adjusted under 35 U.S.C. 154(b) by 50 days.

(21) Appl. No.: 10/120,061

(22) Filed: Apr. 9, 2002

Related U.S. Application Data

(63) Continuation-in-part of application No. 09/767,596, filed on Jan. 22, 2001, now Pat. No. 6,394,567, which is a continuation-in-part of application No. 09/569,660, filed on May 12, 2000, now abandoned.

(51) Int. Cl.[7] ..... A47B 88/04

(52) U.S. Cl. ..... 312/334.41; 312/330.1; 312/334.5

(58) Field of Search ..... 312/330.1, 334.33, 312/334.27, 334.37, 334.38, 334.39, 334.41, 334.8, 334.12, 334.13, 334.16, 334.18, 334.22, 334.46, 348.1, 348.2, 334.1, 334.5, 334.7, 334.19, 334.21, 334.43, 334.42

(56) References Cited

U.S. PATENT DOCUMENTS

| | | | | | |
|---|---|---|---|---|---|
| 233,796 | A | * | 10/1880 | Pines | 215/360 |
| 1,315,922 | A | * | 9/1919 | Franklin | 312/334.39 X |
| 1,951,390 | A | * | 3/1934 | Barker | 312/334.19 |
| 2,273,918 | A | * | 2/1942 | Zalkind | 312/334.38 X |
| 3,056,641 | A | * | 10/1962 | Parmet | 312/334.37 X |
| 3,272,583 | A | * | 9/1966 | Averdieck | 312/334.38 X |
| 3,372,966 | A | * | 3/1968 | Duy | 312/334.36 X |
| 3,441,330 | A | * | 4/1969 | Wildi | 312/333 |
| 4,140,355 | A | * | 2/1979 | Swain | 312/330 X |
| 5,421,647 | A | | 6/1995 | Simons | |
| 5,761,786 | A | | 6/1998 | Simons | |
| 5,785,402 | A | * | 7/1998 | DeLorenzo | 312/350 |

FOREIGN PATENT DOCUMENTS

| | | | | |
|---|---|---|---|---|
| FR | 1249354 | * | 11/1960 | 312/334.8 |

* cited by examiner

*Primary Examiner*—Janet M. Wilkens
(74) *Attorney, Agent, or Firm*—Anderson & Morishita; Robert Ryan Morishita

(57) ABSTRACT

A modular drawer system for mounting a movable drawer within a cabinet having a floor includes a drawer having a bottom and side walls. Rollers are mounted to and extend from the side walls. Two guide rails adapted to receive the rollers to mount and guide movement of the drawer are secured to a base, optionally comprising two or more base components. The guide rails are fixed in a substantially parallel relationship at a fixed spacing substantially equal to the spacing between the rollers. The system includes a member for securing the base to the cabinet floor.

8 Claims, 9 Drawing Sheets

METHOD AND DEVICE FOR MOUNTING A MODULAR DRAWER AND SUPPORT INSIDE A CABINET

PRIOR APPLICATION DATA

The present application is a Continuation-in-Part of U.S. patent application Ser. No. 09/767,596 now U.S. Pat. No. 6,394,567 entitled "Method and Device for Mounting a Modular Drawer and Support Inside a Cabinet" filed Jan. 22, 2001 by Applicant herein which, in turn, is a Continuation-in-Part of U.S. patent application Ser. No. 09/569,660, now abandoned, filed May 12, 2000 by Applicant herein.

FIELD OF THE INVENTION

The present invention relates to storage cabinets. Specifically, the present invention is a modular drawer and support device and method for mounting a drawer within a cabinet.

BACKGROUND OF THE INVENTION

It is well known in the art that there are advantages to substituting fixed shelves in storage cabinets with movable shelves or drawers. A key difference is that objects stored at the back of a fixed shelf is not accessible while movable shelves and drawers allow full utilization of the cabinet space.

There are various devices and methods known in the art for installing drawers inside cabinets. One system known in the art includes attaching guides directly to the sides of the cabinet to mate with runners on the sides of a drawer. However, this system cannot be installed in cabinets with intermediate supports. Also, the drawers must be continuous across the width of the cabinet.

One attempt to address these drawbacks is disclosed in U.S. Pat. Nos. 5,421,647 and 5,761,786 to Simons. The device shown in these references include guides attached to columns that are, in turn, secured to the floor of a cabinet. However, a drawback of this device is that the columns supporting the guides are independent. That is, each side must be placed in the cabinet in the correct position separately. In a confined space such as a cabinet, it can be difficult to position the columns parallel to one another, with the correct spacing, at the correct alignment to allow the drawer to move freely along the guides. Moreover, once positioned, an installer must correctly locate the holes in the brackets securing the columns. Even if corrected positioned and located, the act of installing screws through the holes in the columns may cause the columns to shift out of alignment. Any error in the measuring, positioning, or installing of the columns can cause the drawer to bind inside the guides.

Therefore, it can be seen that there is a need in the art for a modular drawer and support that may be easily installed in a cabinet that reduces or eliminates the possibility of misalignment and errors in positioning and installation.

SUMMARY OF THE INVENTION

A device for mounting a movable drawer within a cabinet having a floor includes a drawer and a support. The drawer includes a bottom, the width of which defines a footprint, opposing parallel side walls, and rollers mounted to and extending from the side walls. Optionally, the rollers are combined with runners to provide additional support. The side walls cooperate with the bottom to define a container with an open top.

The support includes a base and two guide rails to receive the rollers to mount and guide movement of the drawer. The base may, in an optional embodiment, comprise base components and, in a further optional embodiment, cross braces. The guide rails are secured to the base in a substantially parallel relationship at a fixed spacing equal to the spacing between the rollers. Optionally, the guide rails are secured to the base using angle brackets. The device includes means for fixing the support to the cabinet floor.

The present invention also includes a method for mounting a movable drawer within a cabinet having a floor. The method is directed to drawers of the type having a bottom, the width of which defines a footprint, and rollers secured to and extending from the side walls of the drawer. The method begins with providing a base and two guide rails adapted to receive said rollers to mount and guide movement of the drawer. The guide rails are secured to the base in a substantially parallel relationship at a fixed spacing equal to the spacing between the rollers. The base is secured to the cabinet floor.

It is an object of the present invention to provide a method and device for mounting a movable drawer to the floor of a cabinet. It is a further object of the invention to provide a drawer system for a cabinet that avoids the shifting and misalignment problems of the prior art by providing a base that correctly spaces the guide rails prior to installation in the cabinet.

DESCRIPTION

Figure 1:
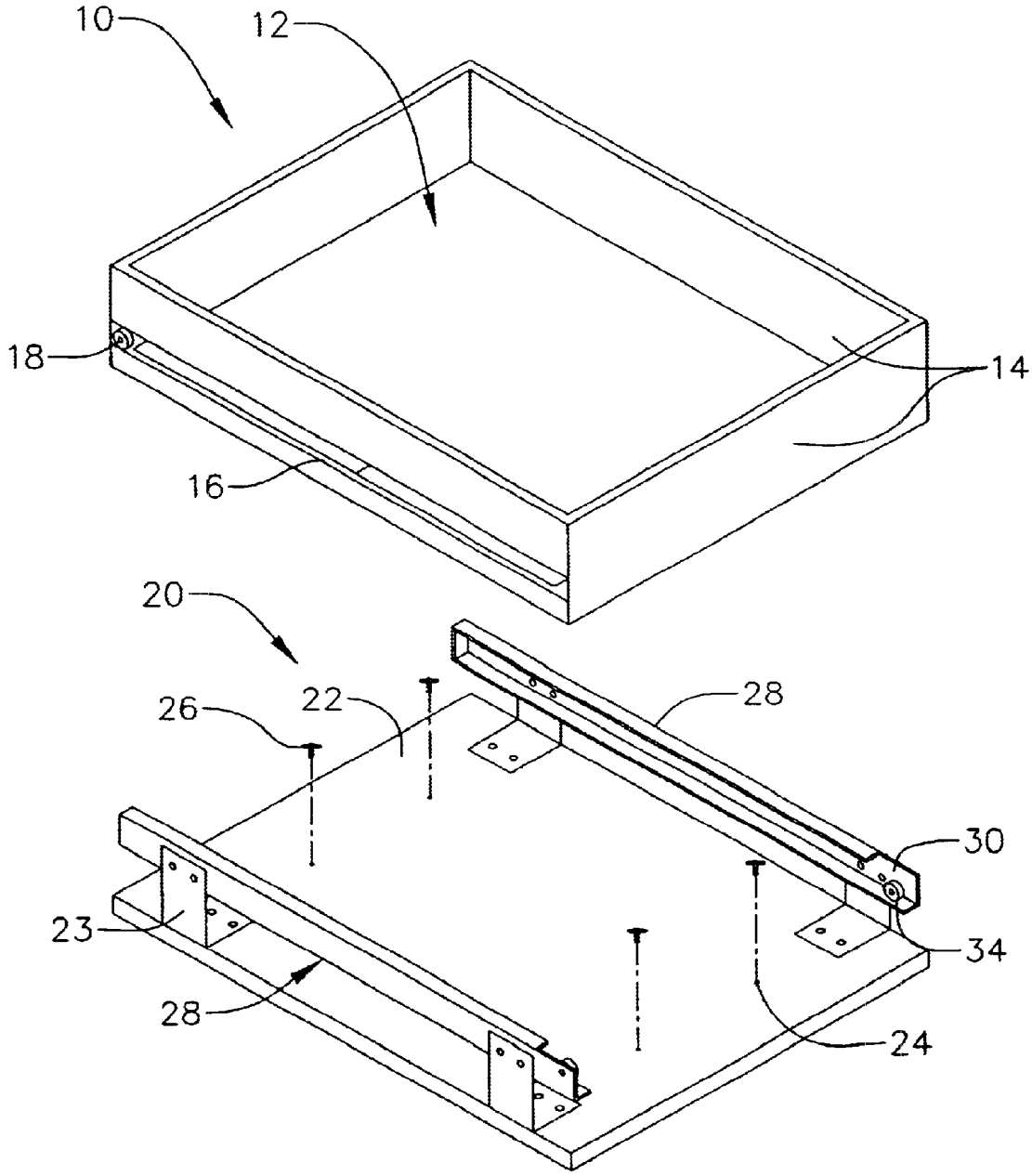
FIG. 1 is an elevated assembly view of a drawer and support according to an embodiment of the present invention.
Figure 2:
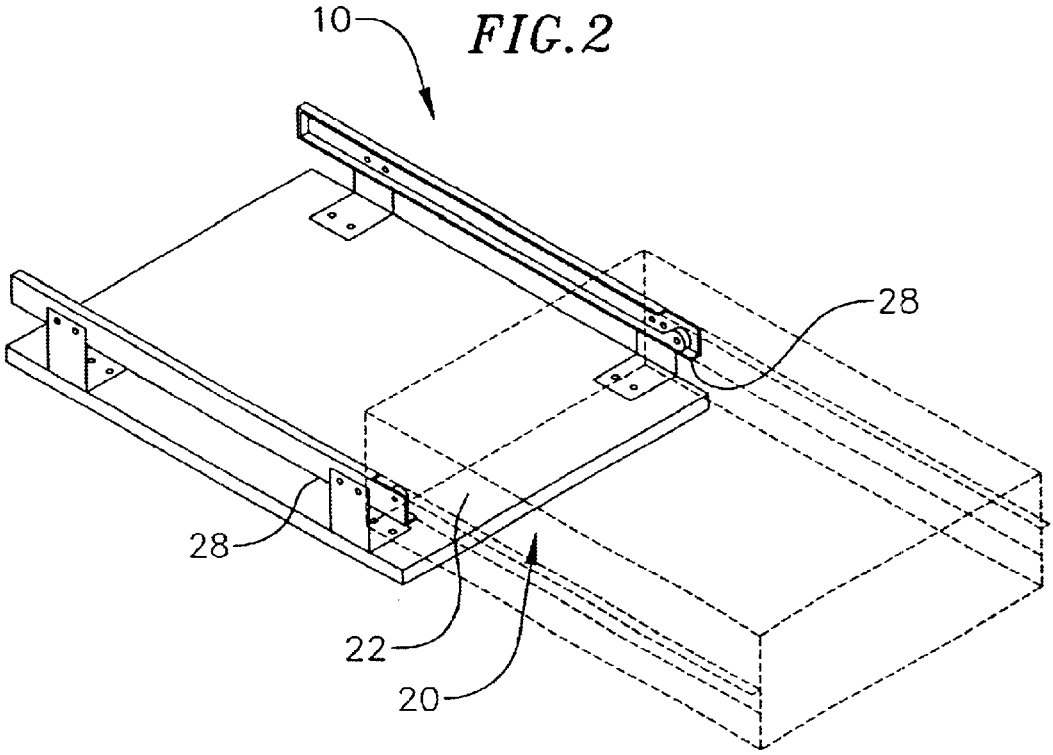
FIG. 2 is an elevated perspective view of the device of the present invention with the drawer in an open position.
Figure 3:
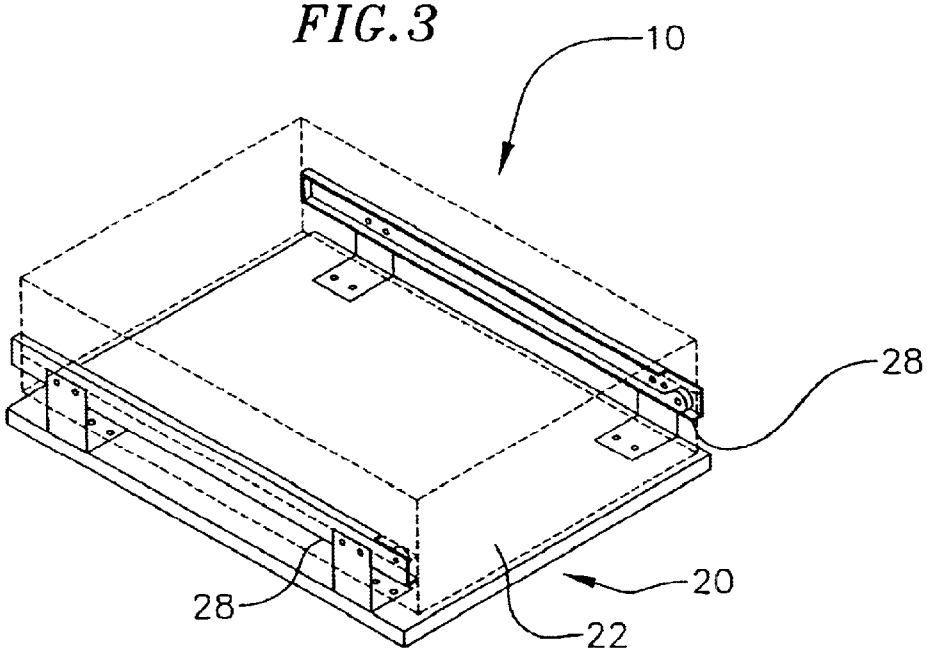
FIG. 3 is an elevated perspective view of the device of the present invention with the drawer in a closed position.

Reference is now made to the figures wherein like parts are referred to by like numerals throughout. The present device is a modular drawer 10 and support 20 for mounting within a conventional cabinet having a floor. With reference to FIGS. 1–3, the device of the present invention includes two interconnecting parts: a drawer 10 and a support 20. It is important to note that references to the drawer 10 include any structure that may be drawn forward from the cabinet, including rolling shelves, rolling cutting boards, rolling containers, as well as conventional rectangular parallelopiped drawers 10. The drawer 10 includes at least a bottom 12. The width of the bottom 12 defines a footprint. The drawer 10 also includes side walls 14.

Attached to the side walls 14 are freely pivotable rollers 18, optionally mounted inside runners 16 in a manner conventional in the art. As can be seen in the figures, the rollers 18 are mounted to, and extend laterally from, the side walls 14 of the drawer 10. While the number of rollers 18 may vary, in an optional embodiment, there are two rollers 18, one on each side of the drawer 10.

The support 20 includes a base 22. In an optional embodiment, the base 22 is substantially flat and of uniform thickness. The base 22 may optionally include holes 24 through which fasteners 26, such as screws, nails, bolts, or the like, may be disposed to secure the base 22 to the floor of the cabinet. Alternatively, the base 22 may be secured to the floor using adhesives, mechanical clips or fasteners 26, bonding, or the like.

Attached to the base 22 are two guide rails 28. The guide rails 28 are positioned substantially parallel to one another at a fixed spacing substantially equal to the spacing between the rollers 18. The guide rails 28 may be attached to the base 22 in any fashion known in the art including mechanical fasteners, adhesives, or the like. In an optional alternate embodiment, the guide rails 28 are elevated above the base 22 using angle brackets 23.

Figure 14:
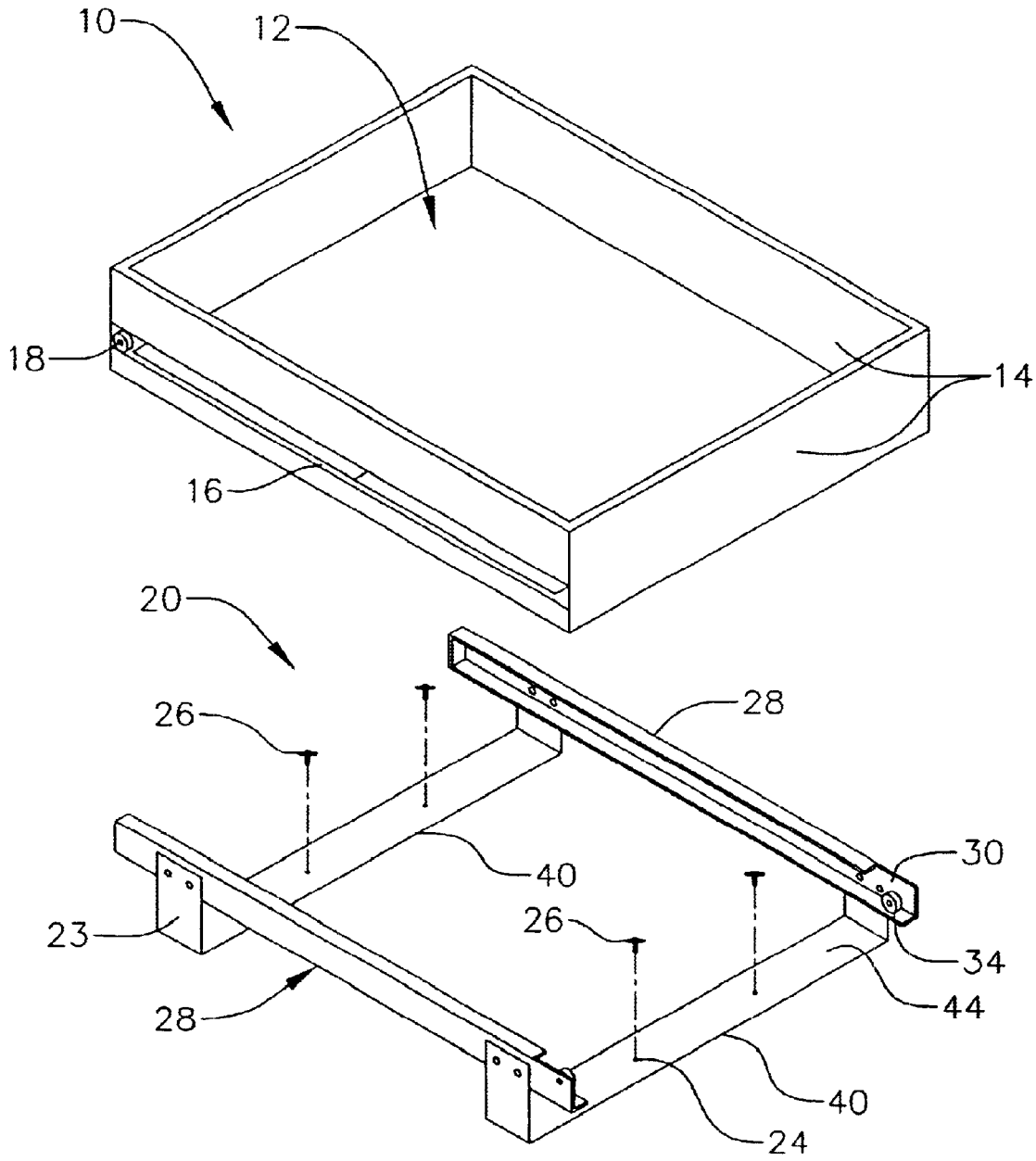
FIG. 14 is an elevated assembly view of a drawer and support according to an embodiment of the present invention.

The base 22 may be a unitary, substantially continuous piece, such as shown in FIGS. 1–7, or the base 22 may comprise two or more base components 40 spaced from one another connecting the guide rails 28, as shown in FIGS. 8–14. In one optional embodiment, shown in FIGS. 8–10, the base components 40 and guide rails 28. cooperate maintain the the guide rails 28 substantially parallel at a fixed spacing substantially equal to the spacing between the rollers 18. In a further optional embodiment, shown in FIGS. 11–13, one or more cross braces 42 may connect and space the base components 40. For example, in the optional embodiment of FIGS. 11–13, the base components 40 and cross braces 42 are substantially perpendicular to form a base 22 in the shape of a rectangular lattice with a central opening, although it is contemplated that the base 22 could form a lattice of any shape. It is also contemplated that the base components 40 and brackets may be integral as shown in FIG. 14 to form a substantially continuous U-shaped base component 44.

Referring generally to FIGS. 1–14, the guide rails 28 are shaped to receive the runners 16 and engage the rollers 18 to mount and guide movement of the drawer 10 as it is drawn. In an optional embodiment, the guide rails 28 are U-shaped with the opening of the guide rails 28 directed toward the center of the base 22. The guide rails 28 include a slot 30 for inserting the rollers 18 to mount the rollers 18 and runners 16 inside the guide rails 28. The guide rails 28 may optionally include a downward slope 32 at the back of the rails so that the area of the drawer 10 near the rollers 18 is at a slightly lower position when the drawer 10 is closed. This slope 32 maintains the drawer 10 in the closed position.

Guide rollers 34 may also be disposed along the guide rails 28 or, alternatively, aligned with the rollers 18 as shown in FIGS. 1–3, to support the drawer 10 and facilitate opening and closing of the drawer 10.

Figure 4:
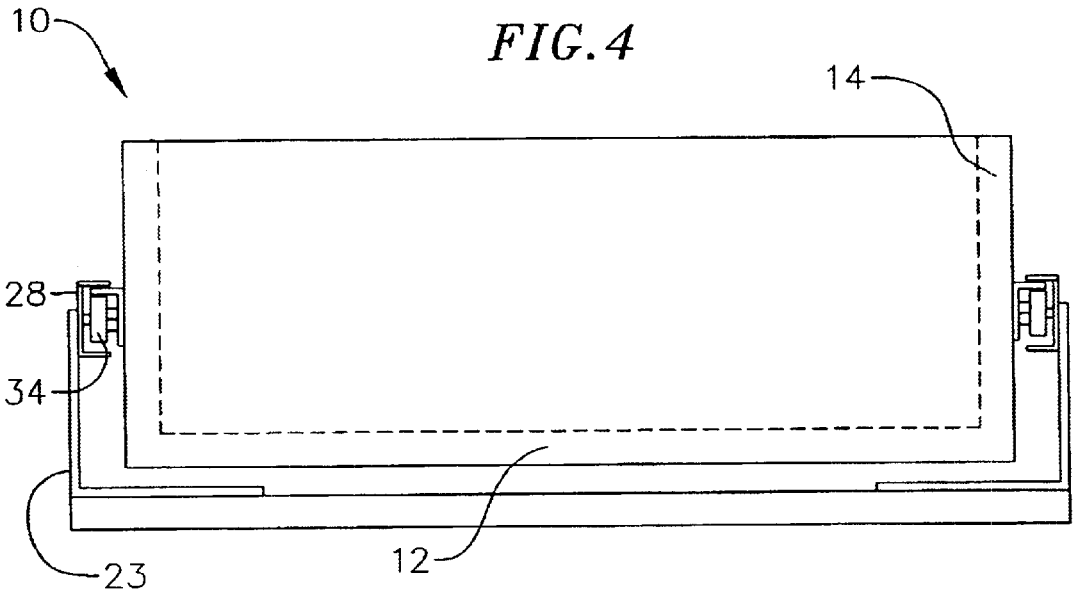
FIG. 4 is a front view of the drawer and support according to an embodiment of the present invention.
Figure 5:
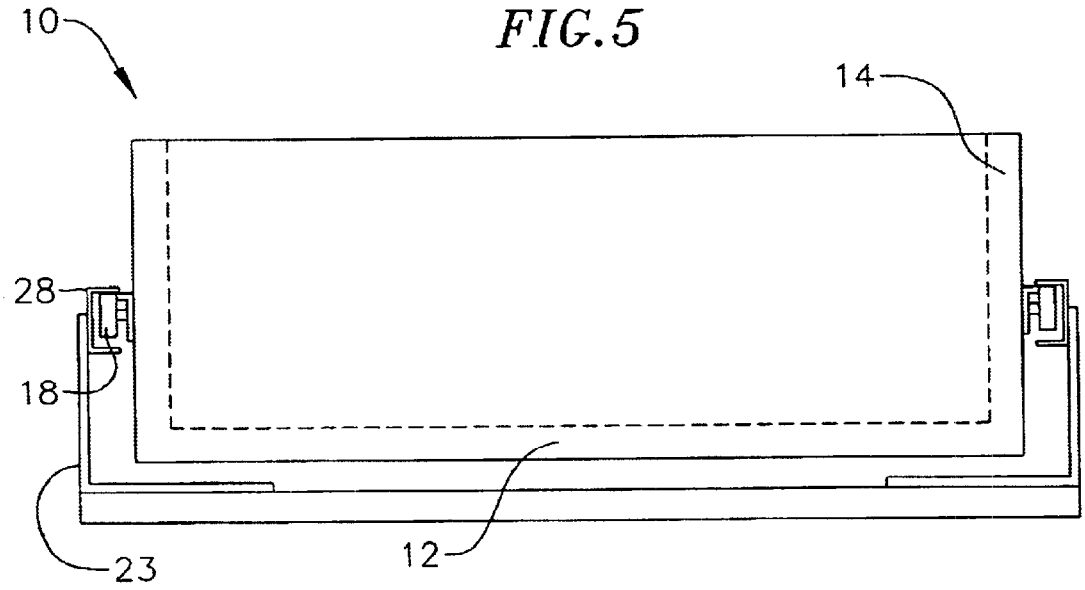
FIG. 5 is a rear view of the drawer and support according to an embodiment of the present invention.
Figure 6:
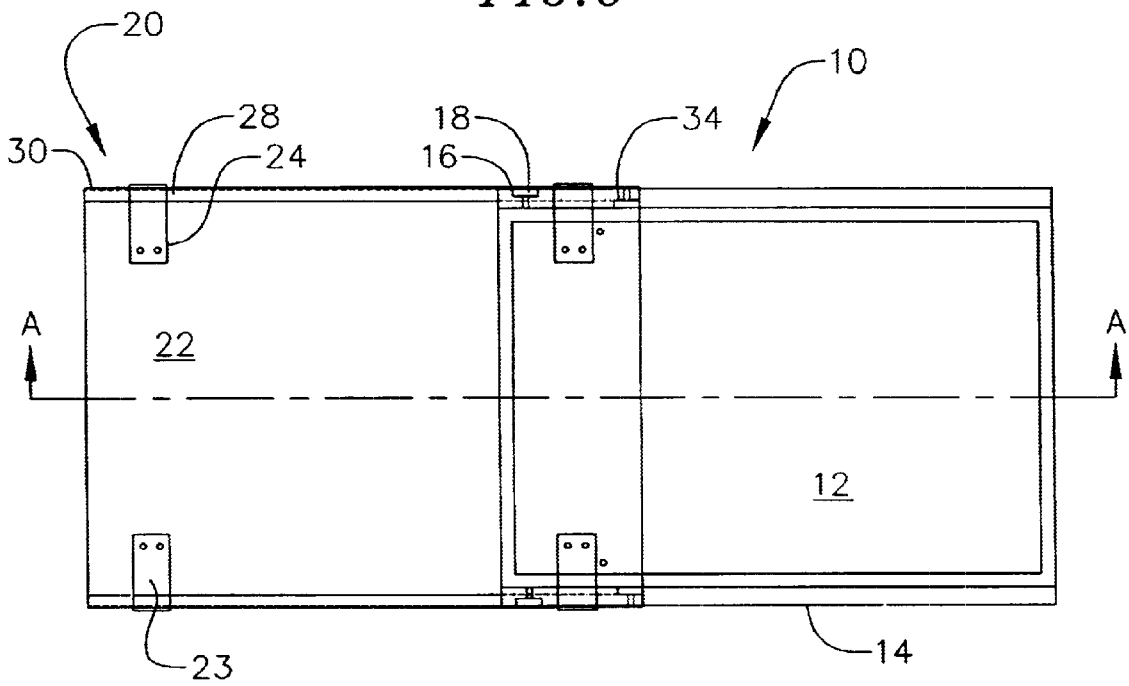
FIG. 6 is a top view of the drawer and support of the present invention with the drawer in an open position.
Figure 7:
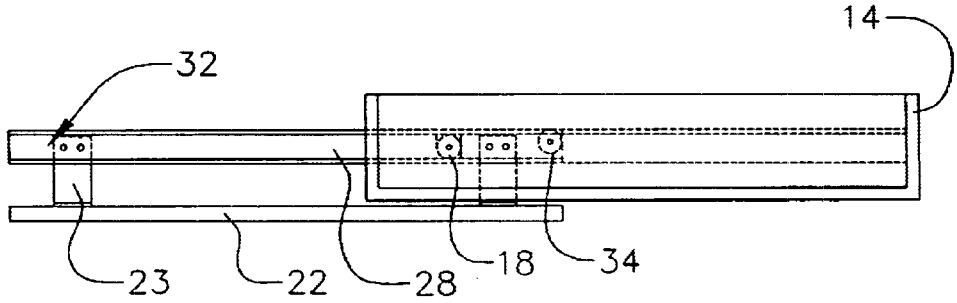
FIG. 7 is a cutaway side view taken along line A—A of FIG. 6 showing the drawer and support of the present invention with the drawer in an open position.
Figure 8:
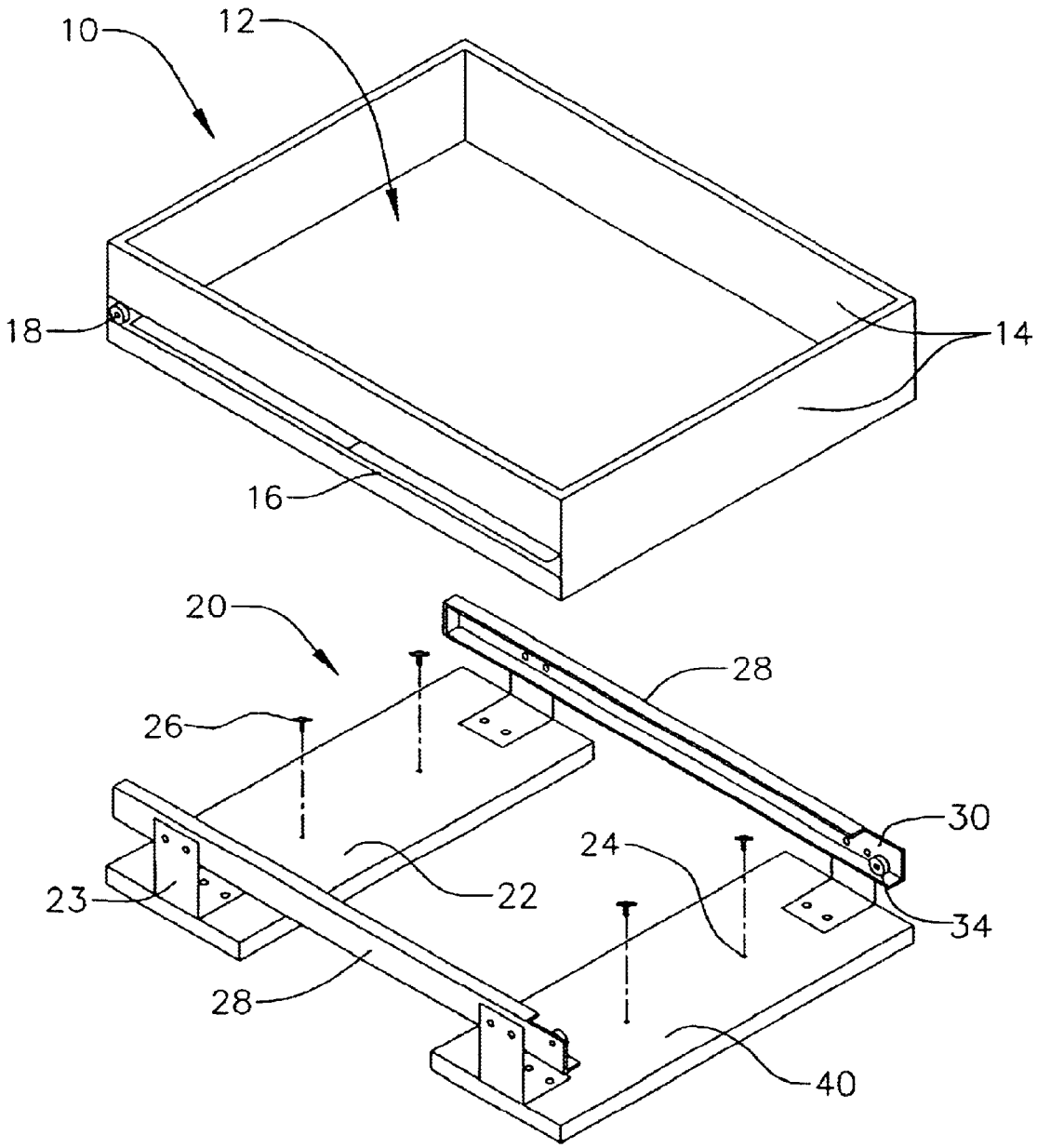
FIG. 8 is an elevated assembly view of a drawer and support according to an alternate embodiment the present invention.
Figure 9:
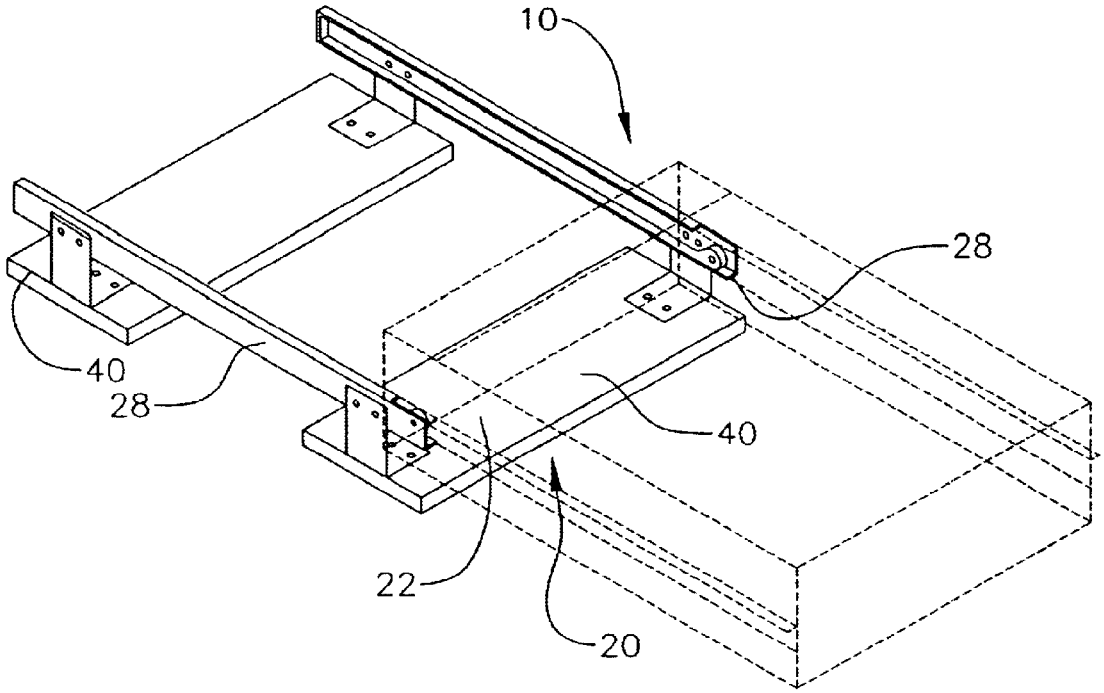
FIG. 9 is an elevated perspective view of the device of the alternate embodiment of FIG. 8 with the drawer in an open position.
Figure 10:
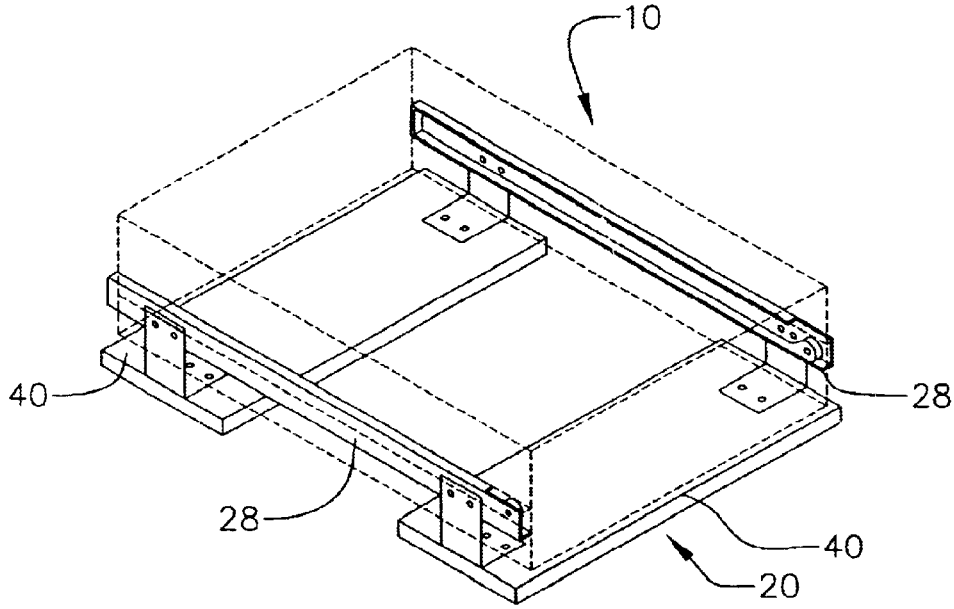
FIG. 10 is an elevated perspective view of the device of the alternate embodiment of FIG. 8 with the drawer in a closed position.
Figure 11:
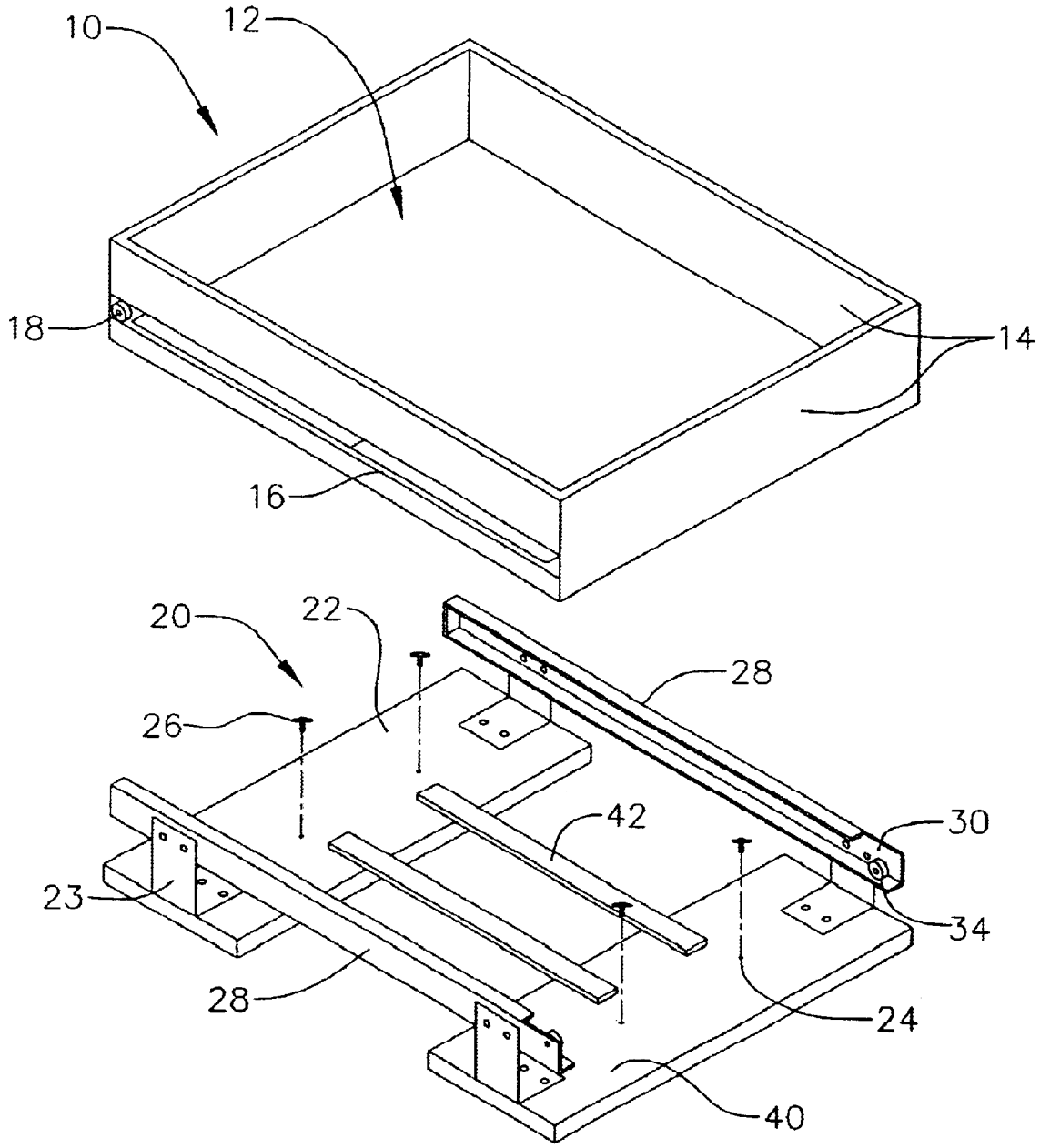
FIG. 11 is an elevated assembly view of a drawer and support according to an embodiment of the present invention.
Figure 12:
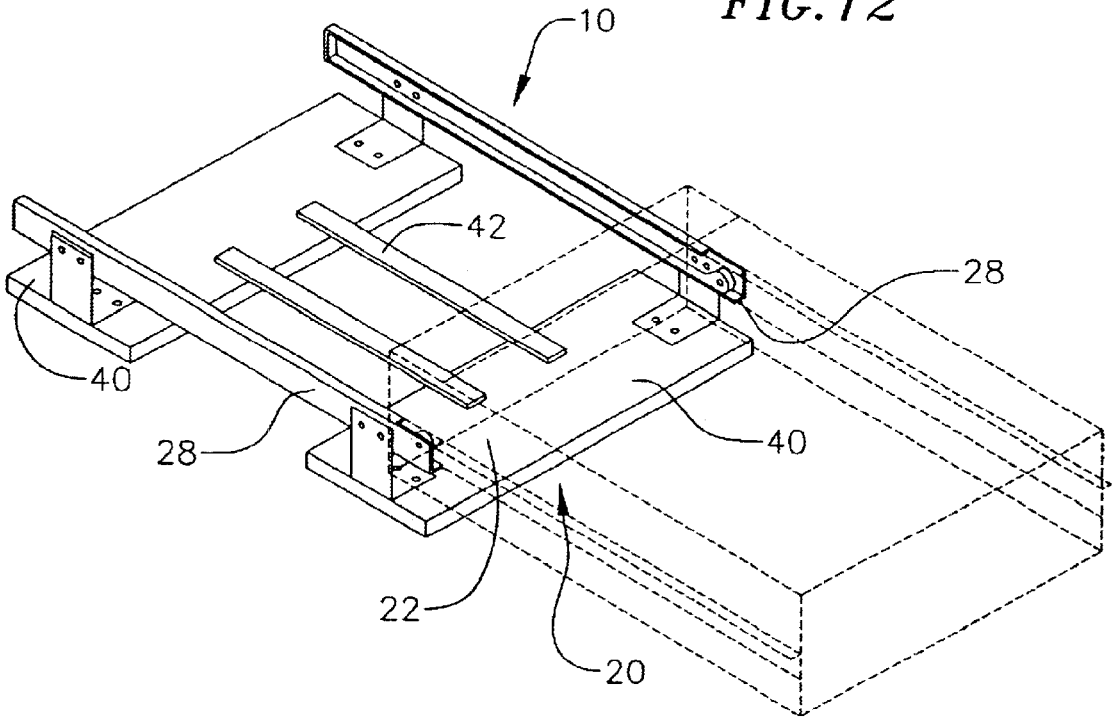
FIG. 12 is an elevated perspective view of the device of the alternate embodiment of FIG. 11 with the drawer in an open position.
Figure 13:
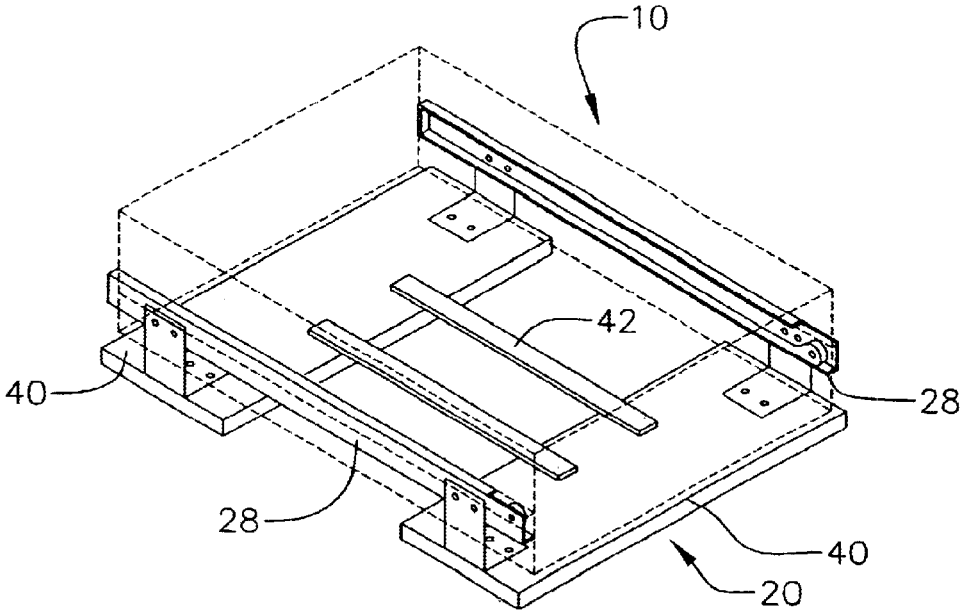
FIG. 13 is an elevated perspective view of the device of the alternate embodiment of FIG. 11 with the drawer in a closed position.

The drawer 10 and support 20 are assembled by aligning the rollers 18 with the slots 30 on the guide rails 28. The drawer 10 is lowered until the rollers 18 rest on the bottom 12 of the guide rails 28 and the runners 16 of the drawer 10 rests on the guide rollers 34 as shown in FIGS. 4 and 5. In use, the drawer 10 may be rolled forward into an open position in which the drawer 10 protrudes from the cabinet as shown in FIGS. 2, 6, and 7. The drawer 10 may also be rolled back into a closed position in which the base 22 is directly under the drawer 10 as shown in FIG. 3.

Referring again to FIG. 1, the system of the present invention is installed by first securing the base 22 to the floor of the cabinet. Because the guide rails 28 are already secured to the base 22 in a substantially parallel relationship to one another at a spacing substantially equal to the spacing between the rollers 18, no alignment, measuring, or installation of the guide rails 28 is necessary. Thus, the system of the present invention avoids the shifting and misalignment problems of the prior art by providing the element of a base 22 that correctly spaces the guide rails 28 prior to installation in the cabinet. The drawer 10 is installed into the guide rails 28 as previously described.

While certain embodiments of the present invention have been shown and described it is to be understood that the present invention is subject to many modifications and changes without departing from the spirit and scope of the claims presented herein.

I claim:

1. A method for retrofitting an existing cabinet having a planar floor with a movable drawer of the type having a bottom, side walls, and rollers mounted to and extending from the side walls, comprising:

providing a base separate from said cabinet floor with brackets mounted thereon secured to two guide rails, said base comprising two or more base components secured to said guide rails through said brackets to cooperate with said guide rails to maintain the guide rails substantially parallel at a fixed spacing substantially equal to the spacing between the rollers, said brackets elevating said guide rails above said base to engage the rollers extending laterally from the sides of said drawer side walls;

securing said guide rails to said base prior to securing said base to the cabinet floor; and securing the base to the planar surface of the cabinet floor.

2. The method of claim 1 wherein said base components are secured perpendicular to said guide rails.

3. The method of claim 1 wherein said base further comprises cross braces connecting said base components to one another.

4. The method of claim 1 wherein said brackets and said base components are integrally formed.

5. A retrofit kit for mounting a modular drawer system having a movable drawer within an existing cabinet having a planar floor, the kit comprising:

a drawer defined by a bottom wall and side walls;

runners mounted to and extending laterally from said side walls, said runners including rollers rotating on an axis perpendicular to said side walls;

two guide rails adapted to receive the rollers to mount and guide movement of the drawer;

brackets secured to said guide rails;

a base separate from said cabinet floor, the base comprising two or more base components secured to said guide rails through said brackets to cooperate with said guide rails to maintain the guide rails substantially parallel at a fixed spacing substantially equal to the spacing between the rollers, said brackets elevating said guide rails above said base to engage the rollers extending laterally from the sides of said drawer side walls; and means for securing the base to the planar surface of the cabinet floor.

6. The retrofit kit of claim 5 wherein said base components are secured perpendicular to said guide rails.

7. The retrofit kit of claim 5 wherein said base further comprises cross braces connecting said base components to one another.

8. The retrofit kit of claim 5 wherein said brackets and said base components are integrally formed.

* * * * *